United States Patent [19]

Brotzmann et al.

[11] 4,322,244

[45] Mar. 30, 1982

[54] PROCESS FOR FEEDING CARBON TO AN IRON MELT IN A CONVERTER

[75] Inventors: Karl Brotzmann; Hans G. Fassbinder, both of Sulzbach-Rosenberg, Fed. Rep. of Germany

[73] Assignee: Eisenwerk-Gesellschaft Maximilianshutte mbH, Fed. Rep. of Germany

[21] Appl. No.: 212,484

[22] Filed: Dec. 3, 1980

[30] Foreign Application Priority Data

Dec. 11, 1979 [DE] Fed. Rep. of Germany ..... 2949794

[51] Int. Cl.[3] ..... C21C 5/32; C21C 5/34

[52] U.S. Cl. ..... 75/51; 75/52; 75/59; 75/60

[58] Field of Search ..... 75/51, 52, 59, 60

[56] References Cited

U.S. PATENT DOCUMENTS 4,089,677 5/1978 Spenceley ..... 75/51

*Primary Examiner*—Peter D. Rosenberg

*Attorney, Agent, or Firm*—Lawrence I. Field

[57] ABSTRACT

A process for producing steel in a convertor in which energy is supplied by introducing carbon containing materials into a pig iron melt in said convertor and oxygen is supplied to said melt, and the supply of carbon containing materials to said melt is discontinued when the carbon in said melt is not lower than 2%, and thereafter completing the refining of said melt with oxygen whereby the nitrogen content of the finished steel produced is lower than it would have been had the supply of carbon to said melt been continued to the end of refining.

4 Claims, No Drawings

PROCESS FOR FEEDING CARBON TO AN IRON MELT IN A CONVERTER

The present invention relates to a process for steelmaking, wherein energy is supplied by carbon-containing materials below the bath surface to an iron melt in the converter and during the refining time, said converter comprising top-blowing or through-blowing oxygen-supply means, for the purpose of achieving lower nitrogen contents in the steel.

It is known to blow carbonaceous materials into an iron melt. The carbon supply to an iron melt is employed mostly to improve the caloric efficiency and to increase the scrap melting capacity. For instance German Auslegeschrift 23 16 768 describes a method for feeding solid carbon carriers with a grain size less than 200 microns together with a carrier gas and oxygen into a pig iron melt in the refining vessel. At the same time the purpose of the suspension of solid carbon carriers and conveying gas is to protect the tuyeres introducing the oxygen. This method suffers among other drawbacks from the fact that the carbon carriers practically must be introduced during the entire time of refining into the melt, as they are used to protect the tuyeres.

The German Offenlegungsschrift 28 16 543 describes a method for increasing the scrap proportion in the oxygen blow-through converter up to steelmaking of solid iron carriers, for instance scrap and pre-reduced iron ores. The moment there is a melt in the converter, carbonaceous fuels are blown in. The German patent application P 28 38 983, as yet not published, comprises a method for significantly improving the caloric efficiency of the carbonaceous fuels fed to the melt. The essential characteristic of the invention is to simultaneously blow oxygen into the melt and onto the bath, and to return the heat gained in the upper converter region from the $CO_2$ after-combustion into the melt.

The method of the German patent application P 29 34 333.7, as yet unpublished, has been found practical as a process for adding the carbon-containing substances, in particular the carbonaceous fuels. In this method, oxygen or the carbonaceous fuels in suspension with a carrier gas are alternatingly introduced through an oxygen feed pipe, for instance a tuyere made of two concentric pipes, in the melt below the bath surface.

The teachings of the last three cited patent applications indicate in advantageous manner how to increase the amount of heat made available to an iron melt by adding carbonaceous fuels, for instance in order to increase the scrap proportion in steelmaking, or to produce a steel melt in the converter without using liquid pig iron. However when these processes were applied in operation, and compared to the purely oxygen blow-through process, higher nitrogen contents were obtained in the finished steel. Where ordinarily nitrogen contents of 20 to 30 ppm are found in the oxygen blow-through process, very varying nitrogen contents between 30 and 100 ppm were found when using carbonaceous fuels, for instance coke dust.

This increase in nitrogen is unexpected, and at first there is no explanation for it, as the nitrogen solubility drops when the oxygen potential in the melt rises, i.e., for low carbon contents. Thus by rinsing with nitrogen for 1 to 2 minutes at the end of refining, it is possible to lower the hydrogen contents in steel without there being a sensible absorption of nitrogen.

It is the object of the present invention to produce low nitrogen contents in the final-refined steel when introducing carbon, preferably carbonaceous fuels below the bath surface into a melt, to do this economically and operationally reliably, said nitrogen contents being comparable with those of the oxygen blow-through process.

This object is attained by the invention by introducing the carbon-containing materials in suspension with a carrier gas simultaneously with oxygen, with or without CaO loads for slag formation, below the bath surface, through tuyeres surrounded by a protective medium, into the melt, the supply of the carbon-containing materials being terminated at a melt carbon content of at least 2% approximately and the iron melt being further refined for at least about 5 minutes in order to achieve low steel nitrogen contents.

The process of the invention is based on the recognition that, surprisingly, the nitrogen contents of the carbon-containing materials, in particular ground, carbonaceous fuels, are more intensively absorbed by the iron bath than the nitrogen introduced in gaseous form.

On the average the ground carbonaceous fuels used, for instance coal of various grades or coke dust, contain about 1% nitrogen.

If for instance about 20 kg of the ground carbonaceous fuels per $m^3$ of nitrogen are blown into the iron bath, then the melt receives about 0.2 kg of nitrogen from the fuel and about 1.2 kg of nitrogen from the carrier gas. If the carrier gas is replaced by an inert gas, for instance argon, while the blowing-in technique remains the same, then surprisingly hardly any differences will be found in the nitrogen contents in the finished steel.

In the process of the invention, the introduction of the carbon-containing materials into the bath region of the melt in a converter in which oxygen is blown through the melt and as a free jet onto the bath, is terminated at a relatively high melt carbon content of at least 2%. Thereupon only oxygen will be fed to the melt. The portion of oxygen that is blown-in below the bath surface may be advantageously loaded with lime dust for the purpose of slag formation. In accordance with the invention, the refining time with oxygen without carbon supply should be carried out over the longest possible time interval to the end of refining, but at least about 5 minutes. During the above described refining period with pure oxygen, without carbon supply, hereafter called the oxygen refining time, the nitrogen dissolved in the bath is extensively rinsed manifestly on account of the pronounced CO generation in the melt at its higher carbon content.

Surprisingly, when applying the process of the invention, the finished steel melt once again evinces nitrogen contents of the order of magnitude of 20 ppm, such as are known from the pure oxygen blow-through process. The blowing-in rates of the carbon-containing materials within the first segment of the refining period, which is prior to the oxygen refining time, may be varied within wide limits.

The amount of carbon blown in per unit time principally is determined by the total amount of the carbon-containing materials which are to be supplied; care must be taken that the carbon saturation value of the melt not be exceeded, that is, that the carbon content in the iron melt remain less than about 4%. The carbon content of the melt can be computed with adequate accuracy from the amount of oxygen supplied as a function of the analysis, i.e. of the oxygen consumption of the input materials loaded into the converter.

In accordance with the invention, the melt carbon content also may assume values less than 2% during the first half of the refining time, and rise again in relation to the supply in carbon and oxygen, whereby this carbon content at the end of the carbon supply amounts to at least 2%. This carbon supply may be arbitrarily varied during this first blow-in half, or it may also be carried out along a firmly fixed plan or at a constant blow rate. Ordinarly the blow-in rate of the carbon-containing materials is lower at the onset of the refining time during the melt desiliconization, then is raised and kept approximately constant until the end of the blowing-in.

The invention is described in further detail below in relation to a non-limiting example.

Ten oxygen introduction tuyeres each consisting of two concentric pipes and with an inside diameter of 24 mm for the central oxygen introduction pipe and an annular gap width of 1 mm are located in the bottom of a 60 ton converter. Two of these oxygen introduction tuyeres are provided with reversing valves permitting the alternating introduction of carbon-containing materials, for instance coke dust, and of oxygen. An oxygen top-blowing tuyere with an inside diameter of 50 mm for the oxygen introduction pipe is located above the bath level in the bricking of the converter hood. About half of the total amount of oxygen is blown through this tuyere as a free jet from a distance of about 3.50 m on the bath surface.

36 tons of scrap and 36 tons of liquid pig iron with a composition of 3.5% C, 1% Mn, 0.5% Si, 2% P are loaded into the converter. With the onset of refining, 12,000 $Nm^3/h$ of oxygen are fed through eight bottom tuyeres and 12,000 kg/h of coke dust suspended in 700 $Nm^3/h$ of nitrogen are fed through the two other bottom tuyeres. After about 2 minutes the blowing-in rate of the carbon-containing fuels is raised to 15,000 kg/h. 6,000 $Nm^3/h$ of oxygen are blown onto the bath surface. After a refining time of 12 minutes, the melt carbon content computed from the oxygen rates is about 2%, and the coke dust supply is terminated. The two tuyeres then are used for supplying oxygen. After a total refining time, of 19 minutes, including the two-minute corrective blowing, the finished steel melt with a weight of 65 tons and at a temperature of 1,670° C. is tapped off; its composition is as follows: 0.03% C, 0.1% Mn, 0.025% P, 18 ppm $N_2$. A total of 5,000 $Nm^3$ of oxygen, 100 $Nm^3$ of propane for tuyere protection, 2,500 kg of coke dust, 5,500 kg of lime dust were fed into the melt.

The sense of the invention covers appropriate variations in the process and adapting its high flexibility to operational conditions in the steelworks. As long as the essential characteristic of this invention, namely the termination of the supply of carbon-containing materials upon a melt carbon content of about 2% is kept, the various changes will be within the scope of this invention.

We claim:

1. In a process for steelmaking, wherein energy is supplied in the form of ground carbon-containing materials to a molten iron bath in the convertor during refining, and wherein the refining oxygen is blown through the molten iron bath and as a free jet onto the bath surface, the improvements for the purpose of achieving low nitrogen contents in the steel produced by refining the molten iron bath which comprise: introducing the said carbon-containing materials in suspension with a carrier gas and simultaneously introducing oxygen below the bath surface through tuyeres into the molten iron bath, and terminating the supply of the carbon-containing materials at a carbon content in the molten iron bath of at least about 2%, and thereafter refining the iron melt by oxygen for at least about 5 minutes.

2. Process of claim 1, wherein the carbon-containing materials are fed at varying blow-in rates into the molten iron bath.

3. Process of claims 1 or 2, wherein the carbon content of the bath during the blow-in time of the carbon-containing materials is less than the carbon saturation value, and is less than 4%.

4. Process of any of claims 1 through 3, characterized in that coal of different grades, coke, coke dust, lignite coke, graphite and mixtures thereof are blown in as carbon-containing materials.

* * * * *